United States Patent [19]

Lee

[11] Patent Number: 4,923,415

[45] Date of Patent: May 8, 1990

[54] STRUCTURE OF JUMPER CABLE CLAMP

[76] Inventor: Kuo-Shu Lee, 7F, 16, Alley 3, Lane 227, Nung-An St., Taipei, Taiwan

[21] Appl. No.: 350,389

[22] Filed: May 11, 1989

[51] Int. Cl.[5] ..... H01R 4/30

[52] U.S. Cl. ..... 439/755; 439/504; 439/506

[58] Field of Search ..... 439/755, 759, 504, 506

[56] References Cited

U.S. PATENT DOCUMENTS

| | | | |
|---|---|---|---|
| 3,267,452 | 8/1966 | Wolf | 439/506 |
| 3,745,516 | 7/1973 | Lieberman | 439/755 |
| 4,345,807 | 8/1982 | Shekel et al. | 439/755 |
| 4,420,212 | 12/1983 | Wright | 439/504 |
| 4,565,414 | 1/1986 | French | 439/755 |
| 4,620,767 | 11/1986 | Woolf | 439/755 |
| 4,759,728 | 7/1988 | Cobb | 439/504 |

*Primary Examiner*—P. Austin Bradley
*Attorney, Agent, or Firm*—Ladas & Parry

[57] ABSTRACT

This invention is to provide a new structure of jumper cable clamp to connect car batteries, which includes a conventional clamp having an insulated guide block set in one of the two clamping elements, which guide block is comprising a guide way for setting therein of a conductive charging clip, which conductive charging clip is further connected with an expansion spring, which expansion spring is further connected with an indicator lamp. When in use, the conductive charging clip may be pulled out and firmly engaged by the metal clamping jaw of the opposite clamping element, such that the conductive charging clip is served to clip on the battery terminal. Further, the indicator lamp will be turned on to give a warning signal if the clamp is secured to the wrong battery terminal.

6 Claims, 6 Drawing Sheets

STRUCTURE OF JUMPER CABLE CLAMP

BACKGROUND OF THE INVENTION

The automobile is one of the most important means for transportation and has been popularly used everywhere by people. It is indeed very embarrassing that one's car is out of order while driving. Among the various possible troubles, battery failure is most commonly encountered. More particularly in the cold weather, the low voltage of a battery can be insufficient to start a car. The most convenient way to charge up a car battery under emergency conditions is to use a jumper cable to connect the battery in question to the battery of other car. Therefore, the jumper cable has become one of the requisite tools a car driver has to have on hand.

However, following technology development, the structure of car engines is getting more compact. Every vehicle designer is trying to fully utilize the limited space of a car. As a consequence, the car battery is also being designed to match with the change of the mechanical structure of a car. In order to minimize space consumption or for other related reasons, the battery terminals may be set on the lateral side of the battery. And when this type of battery is set in an engine compartment, it is normally set to be close to other component parts. However, conventional booster cable clamps are either not very convenient for use to clamp or can not clamp on this type of side mounted battery terminal when the battery is set in the engine compartment.

SUMMARY OF THE INVENTION

The present invention is related to a new structure of jumper cable clamp to connect car batteries, which includes an expansible conductive charging clip for use to clip in the battery terminals which are set at the lateral side of a battery. In additional to the function of a conventional clamp, the present invention has a polarity indicator means to provide warning signal if the clamp is secured to the wrong battery terminal.

DETAILED DESCRIPTION OF THE PREFERRED EMBODIMENTS

Figure 1:
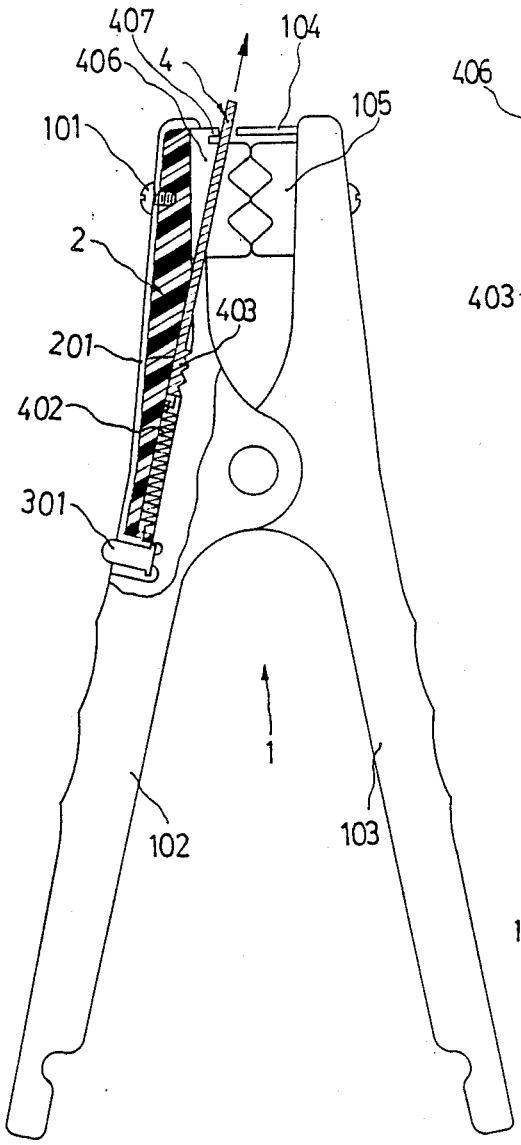
FIG. 1 is a sectional elevation of the present invention.
Figure 2:
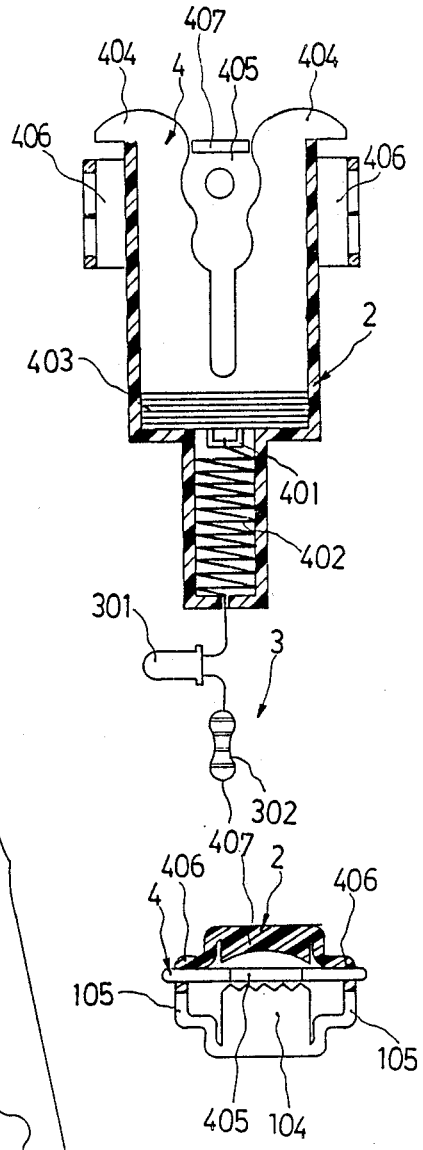
FIG. 2 is a sectional structure view of the guide block and the conductive charging clip.

Referring to FIGS. 1 and 2, the present invention is comprised of a conventional terminal clamp (1), an insulated guide block (2) set in the terminal clamp (1), an indicator lamp (3) (or piezo-electric buzzer), and a conductive charging clip (4).

The insulated guide block (2) which is fixedly set inside the clamping element (102) by means of a screw or a rivet means (101) has an inclined sliding way (201) in which the conductive charging clip (4) is set with a clamping jaw element (406) respectively arranged at both lateral sides, and with a jaw element (407) set at the top. A bottom retaining ring (401) is connected with an expansion spring (402), which expansion spring (402) has its other end fixedly connected to the insulated guide block (2) to further connect with an indicator lamp (or piezo-electric buzzer) (301) and a resistor (302) by means of series connection. Resistor (302) has its other end connected to the metal partly either of the clamping elements (102) or (103).

When the clamp (1) is in use, the metal clamping jaw (105) of the clamping element (103) is fully engaged with the clamping jaw (406) at the front end of the insulated guide block (2), and the top metal clamping jaw (104) of the clamping element (103) is spaced away from the conductive charging clip (4).

Figure 8:
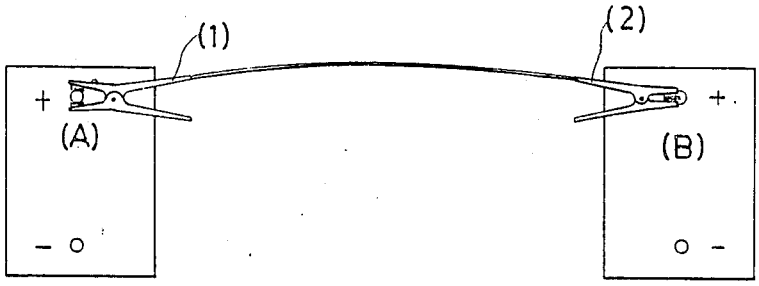
FIG. 8 is a schematic drawing, illustrating two electrical clamps of the present invention are correctly clamping on the respective positive terminals of two separate batteries.
Figure 9:
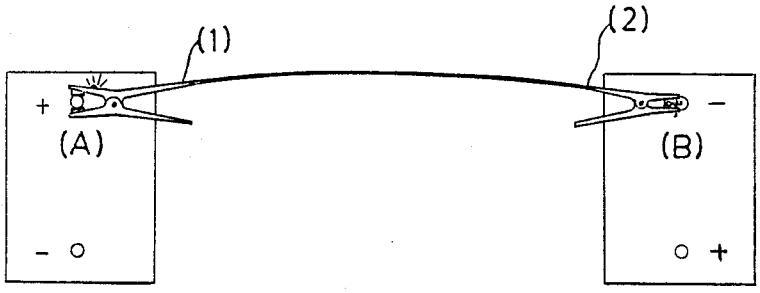
FIG. 9 is a schematic drawing, illustrating two electrical clamps of the present invention are erroneously clamping on two battery terminals.

When a terminal clamp (1) is to be used, as shown in FIGS. 8 and 9, a first terminal clamp is clamped on the positive or negative terminal of a battery A, and a second terminal clamp of the same cable is used to permit the holding ends (404) of the conductive charging clip (4) come into contact with the positive or negative terminal of the battery B. In case the indicator lamp (301) is not turned on or the buzzer does not buzz, it means that correct connection is achieved, that is the positive terminal is connected to positive terminal or negative terminal is connected to negative terminal (as shown in FIG. 8). If the indicator lamp is turned on or the buzzer sounds, that provides a warning that the operator has inadvertently connected the clamp to the wrong battery terminal (as shown in FIG. 9). Therefore, by means of this test process, possible battery explosion or other accidents can be eliminated.

Figure 3:
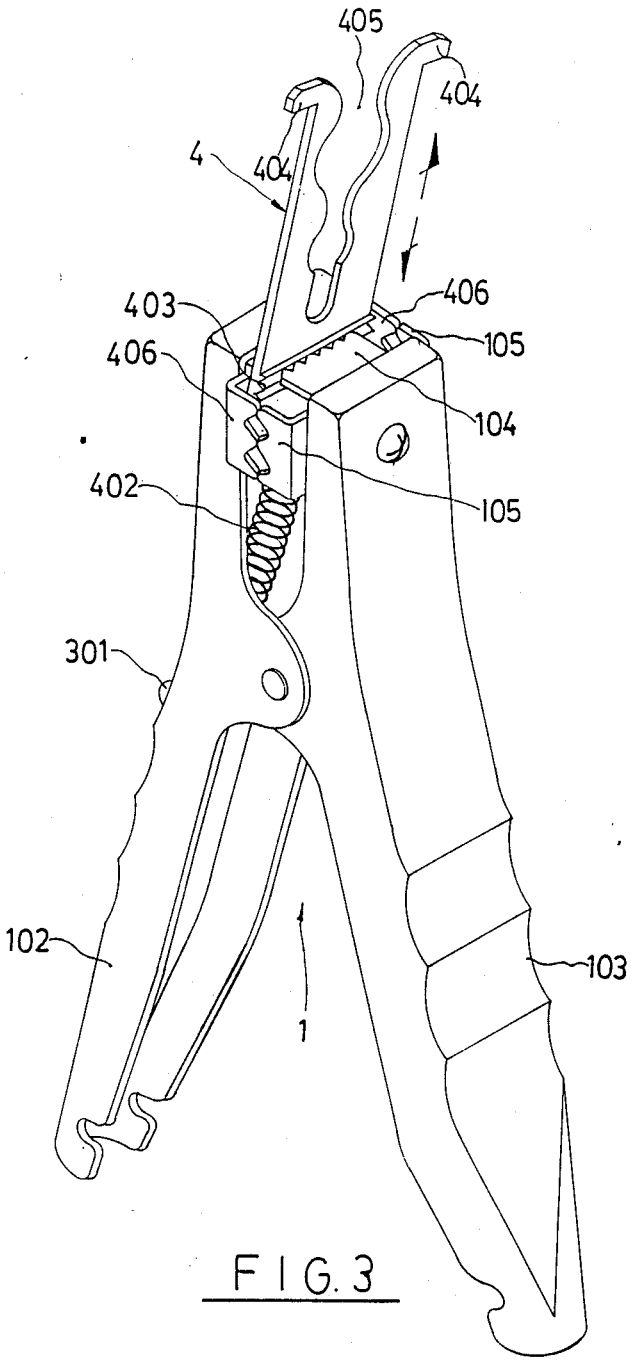
FIG. 3 is a schematic drawing of the present invention wherein the conductive charging clip is pulled out for operation.
Figure 6:
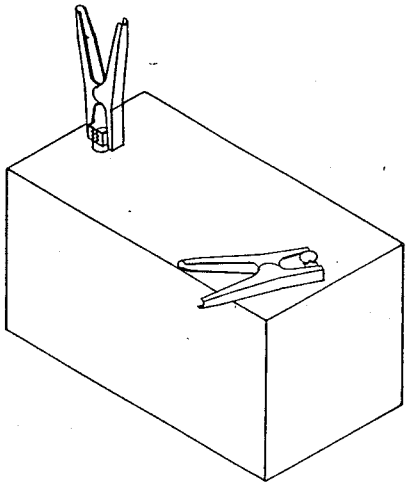
FIG. 6 is a schematic drawing of the present invention applied to clamp on a battery terminal by means of the clamping elements.
Figure 5:
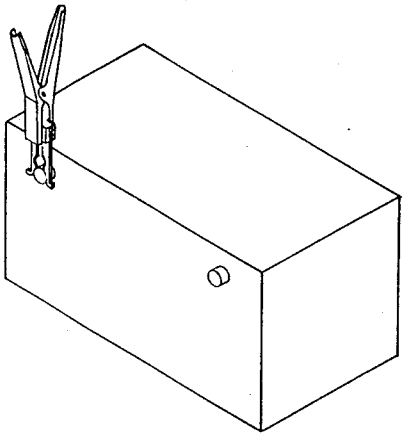
FIG. 5 is a schematic drawing of the present invention applied to clip on a battery terminal by means of the conductive charging clip.

Referring to FIG. 3, when the conductive charging clip (4) is to be used, it is pulled out to permit the top metal clamping jaw (104) of the clamping element (103) to become engaged with the conductive charging clip (4) at the groove (403), such that the conductive charging clip (4) is firmly fixed from retreating backwards when used to clip on a battery terminal by means of the opening (405) depicted therein as shown in FIG. 5). When not in use, the conductive charging clip (4) can be set back into the guide block (2). The top metal clamping jaw (104) or (105) of the clamping element (103) may also be arranged to match with the clamping jaw (406) or (407) of the guide block (2) to clamp up the battery terminal as for same conventional clamping function (as shown in FIG. 6).

Figure 7A:
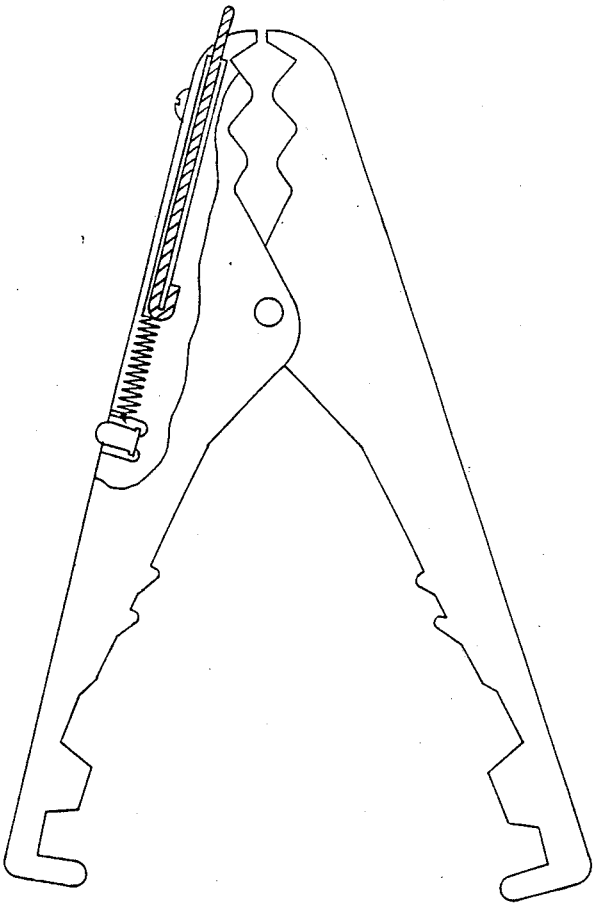
FIGS. 7A and 7B illustrates another embodiment of the present invention.
Figure 7B:
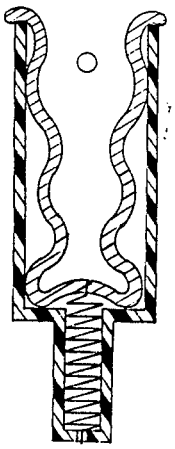

An alternate form of the terminal clamp (1) is as illustrated in FIGS. 7A and 7B. In this embodiment, the conductive charging clip (4) is made of iron wire, and also set inside the guide block.

Figure 4:
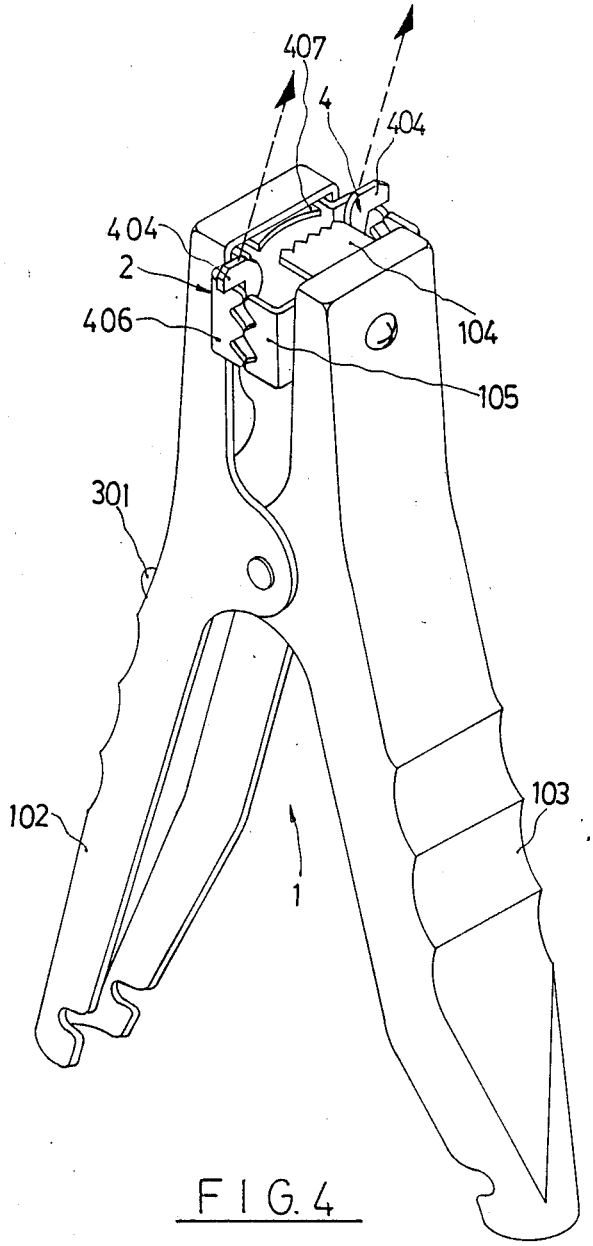
FIG. 4 is a schematic drawing of the present invention wherein the conductive charging clip is retreated inside the guide block.

Please refer to FIG. 4, wherein the holding ends (404) of the conductive charging clip (4) are constantly visible from outside. The whole structure of the charging clip (4), as shown in FIG. 2, is properly set to not interfere with the operation of the terminal clamp (1). It can be conveniently pulled out for operation by means of the holding ends (404), as shown in FIG. 3.

What is claimed is:

1. A jumper cable clamp, including one pair of clamping elements, a guide block set in one of the said clamping elements, said guide block having a slide way in which a conductive charging clip is set, said conductive charging clip being connected with an expansion spring at the bottom, which expansion spring has its other end connected to said guide block so as to let the conductive charging clip be pulled out for operation or retreated back to be received inside said clamping element, said conductive charging clip having a curved opening made at the middle part to serve as an electrical connector clamping means for use to clip on the positive or negative side-mounted terminal of a car battery for electricity transmission.

2. The jumper cable clamp as set forth in claim 1, wherein the said guide block is insulated, having a jaw-typed front end, which is arranged to engage with the metal clamping jaw of the opposite clamping element to separate the said conductive charging clip from the said metal clamping jaw when the connector clamp is not in use.

3. The jumper cable clamp as set forth in claim 1, wherein the conductive charging clip has a groove disposed at its lower end in which groove said conductive charging clip is engaged by the metal clamping jaw of the said opposite clamping element for electricity transmission, when said conductive charging clip is pulled out.

4. The jumper cable clamp as set forth in claim 1, wherein said spring is further connected with a warning means which in turn is connected to a metal part of the clamping elements.

5. The jumper cable clamp as set forth in claim 4, wherein the warning means is a piezo-electric buzzer to provide an audio sound warning signal if one of the two jumper cable clamps is not secured to the right battery terminal.

6. The jumper cable clamp as set forth in claim 4, wherein the warning means is an indicator lamp.

* * * * *